US010421632B2

(12) United States Patent
Cain

(10) Patent No.: US 10,421,632 B2
(45) Date of Patent: Sep. 24, 2019

(54) MULTIPURPOSE RETAINER KIT

(71) Applicant: Mary G. Cain, Milwaukee, WI (US)

(72) Inventor: Mary G. Cain, Milwaukee, WI (US)

( * ) Notice: Subject to any disclaimer, the term of this patent is extended or adjusted under 35 U.S.C. 154(b) by 0 days.

(21) Appl. No.: 16/241,369

(22) Filed: Jan. 7, 2019

(65) Prior Publication Data

US 2019/0135566 A1 May 9, 2019

Related U.S. Application Data

(63) Continuation of application No. 15/639,344, filed on Jun. 30, 2017, now abandoned.

(60) Provisional application No. 62/367,220, filed on Jul. 27, 2016.

(51) Int. Cl.

| | |
|---|---|
| ***B65H 16/00*** | (2006.01) |
| ***B65H 16/04*** | (2006.01) |
| ***B65H 27/00*** | (2006.01) |
| ***A47K 10/22*** | (2006.01) |
| ***B26B 29/04*** | (2006.01) |

(52) U.S. Cl.

CPC ..... *B65H 16/04* (2013.01); *A47K 10/22* (2013.01); *B26B 29/04* (2013.01); *B65H 27/00* (2013.01)

(58) Field of Classification Search

CPC ..... A47K 10/3836; A47K 10/40; A47K 10/16
USPC ..... 248/346.03, 597.3, 597.4, 597.7
See application file for complete search history.

(56) References Cited

U.S. PATENT DOCUMENTS

| | | | | |
|---|---|---|---|---|
| 7,140,573 | B1 * | 11/2006 | Jerstroem | A47K 10/3836 242/597.3 |
| 2006/0219837 | A1 * | 10/2006 | Yang | B65H 16/02 242/597.4 |
| 2006/0266876 | A1 * | 11/2006 | Yang | A47K 10/40 242/597.7 |
| 2006/0284001 | A1 * | 12/2006 | Paradise | A47K 10/3836 242/597.4 |
| 2008/0011782 | A1 * | 1/2008 | Sidman | A47K 5/12 222/192 |
| 2018/0213982 | A1 * | 8/2018 | Taylor | A47K 10/22 |

* cited by examiner

*Primary Examiner* — Steven M Marsh
(74) *Attorney, Agent, or Firm* — Dunlap Bennett & Ludwig PLLC

(57) ABSTRACT

A multipurpose retainer adapted to be used as a roller dispenser and for safely storing scissors or shears is providing in a kit including a base; a tubular element extending from a distal end to a proximal end, the proximal end transversely connected to the base; a plurality of elongated rods perpendicularly extending from a shared base, wherein each elongated rod has a diameter ranging between 0.1 mm and 2 mm, wherein each elongated rod has a length ranging between five and ten inches; and the shared base dimensioned to slide through said tubular distal end so as to be supported by said tubular proximal end so that distal ends of the plurality of elongated rods terminate adjacent to said tubular distal end, wherein the elongated tapered object is slidably received through the tubular distal end and nested within the plurality of elongated rods.

10 Claims, 7 Drawing Sheets

MULTIPURPOSE RETAINER KIT

CROSS-REFERENCE TO RELATED APPLICATION

This application claims the benefit of priority of U.S. provisional application No. 62/367,220 filed 27 Jul. 2016, and the benefit of priority of U.S. Non-provisional application Ser. No. 15/639,344 filed 30 Jun. 2017, the contents for both are herein incorporated by reference.

BACKGROUND OF THE INVENTION

The present invention relates to multipurpose retainers and, more particularly, a multipurpose retainer adapted to be used as a roller dispenser and for safely storing scissors or shears in a logical home from which and to which users can quickly find and return them.

Currently, rolled-materials dispensers serve only to be operatively associated with the rolled materials. Furthermore, prior to the present invention, there has not been a standardized way to store scissors or shears so that they are visually accessible, readily available, and safely stored.

Rolled materials dispensers, such as for paper towels, are found in workshops, workrooms, and kitchens; however, such dispensers take up valuable counter space or under-cabinet space while only performing a single function. None of them provide additional functions such as storage for tools like scissors that would justify this. Also, current dispensers do not have attractive or interesting tops that scissors could provide.

Scissors and shears are useful tools especially in the kitchen. But they are easily misplaced or lost, making them difficult to find when you need them. This extra effort is a waste of time and energy. Scissors can be stored in knife blocks but those take up valuable counter space as well. Current scissor storage does not work well because it is not standardized and lacks efficiency in locating them, for example, scissors can be stored in a drawer but that requires extra effort to open and close a drawer.

As can be seen, there is a need for a multipurpose retainer adapted to be used as a roller dispenser and for safely storing scissors or shears in a logical home from which and to which users can quickly find and return them.

SUMMARY OF THE INVENTION

In one aspect of the present invention, kit for operatively dispensing rolled material and simultaneously storing elongated tapered objects includes a base; a tubular element extending from a distal end to a proximal end, the proximal end transversely connected to the base; a plurality of stopper bolts, each stopper bolt providing a body and a flange portion, wherein a flange diameter of the flange portion is greater than a body diameter of the body, and wherein the body diameter fits within a lumen of the tubular element, while the flange diameter does not; and a donut opening disposed in each flange portion.

In another aspect of the present invention, the kit for operatively dispensing rolled material and simultaneously storing elongated tapered objects includes a base; a tubular element extending from a distal end to a proximal end, the proximal end transversely connected to the base; a plurality of stopper bolts, each stopper bolt providing a body and a flange portion, wherein a flange diameter of the flange portion is greater than a body diameter of the body, and wherein the body diameter fits within a lumen of the tubular element, while the flange diameter does not; a donut opening disposed in each flange portion; each flange portion provides a diameter of the donut opening that differs among the plurality of stopper bolts; the lumen and each body provides cooperating threading; and each body provides at least one staggered opening, each staggered opening having a diameter greater than a diameter of the respective donut opening.

In yet another aspect of the present invention, a kit for operatively dispensing rolled material and simultaneously storing elongated tapered objects includes the following: a base; a tubular element extending from a tubular distal end to a tubular proximal end, the proximal end transversely connected to the base; a plurality of elongated rods perpendicularly extending from a shared base; and the shared base dimensioned to slide through said tubular distal end so as to be supported by said tubular proximal end so that distal ends of the plurality of elongated rods terminate adjacent to said tubular distal end.

In yet another aspect of the present invention, the kit for operatively dispensing rolled material and simultaneously storing elongated tapered objects includes the following: a base; a tubular element extending from a distal end to a tubular proximal end, the tubular proximal end transversely connected to the base; a plurality of elongated rods perpendicularly extending from a shared base, wherein each elongated rod has a diameter ranging between 0.1 mm and 2 mm, wherein each elongated rod has a length ranging between five and ten inches; and the shared base dimensioned to slide through said tubular distal end so as to be supported by said tubular proximal end so that distal ends of the plurality of elongated rods terminate adjacent to said tubular distal end, wherein the elongated tapered object is slidably received through the tubular distal end and nested within the plurality of elongated rods.

In yet another aspect of the present invention, method of converting a tubular element for dispensing rolled material into a container for storing elongated tapered objects includes the following: providing that tubular element that extends from a distal end to a tubular proximal end; providing a plurality of elongated rods perpendicularly extending from a shared base; and sliding the plurality of elongated rods through the tubular proximal end so that the shared base is supported by said tubular proximal end and so that distal ends of the plurality of elongated rods terminate adjacent to said tubular distal end.

These and other features, aspects and advantages of the present invention will become better understood with reference to the following drawings, description and claims.

DETAILED DESCRIPTION OF THE INVENTION

Figure 1:
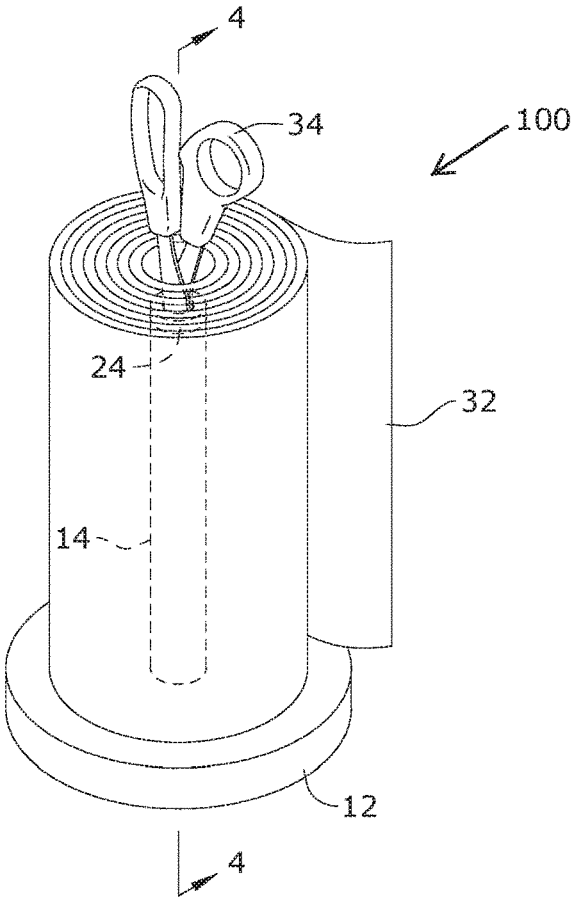
FIG. 1 is a perspective view of an exemplary embodiment of the present invention, shown in use.
Figure 2:
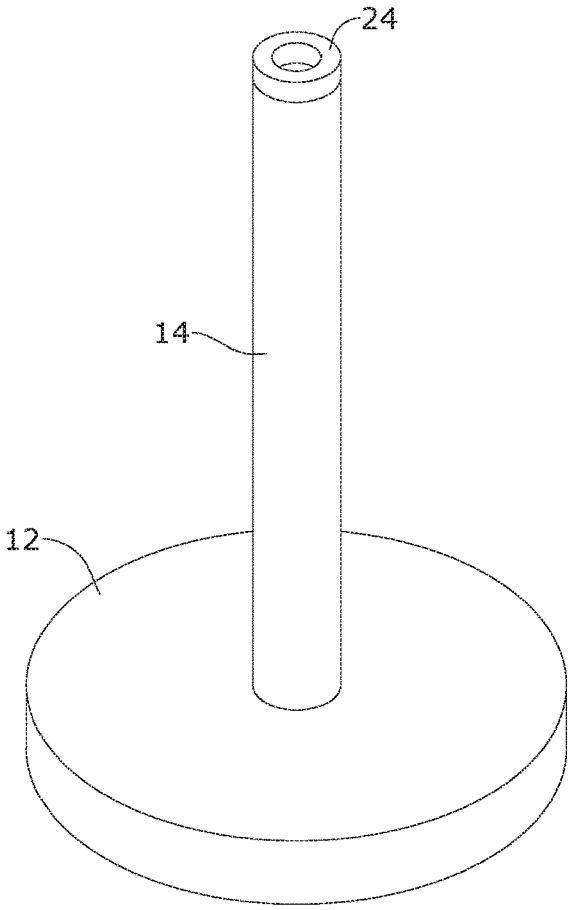
FIG. 2 is a perspective view of an exemplary embodiment of the present invention.
Figure 3:
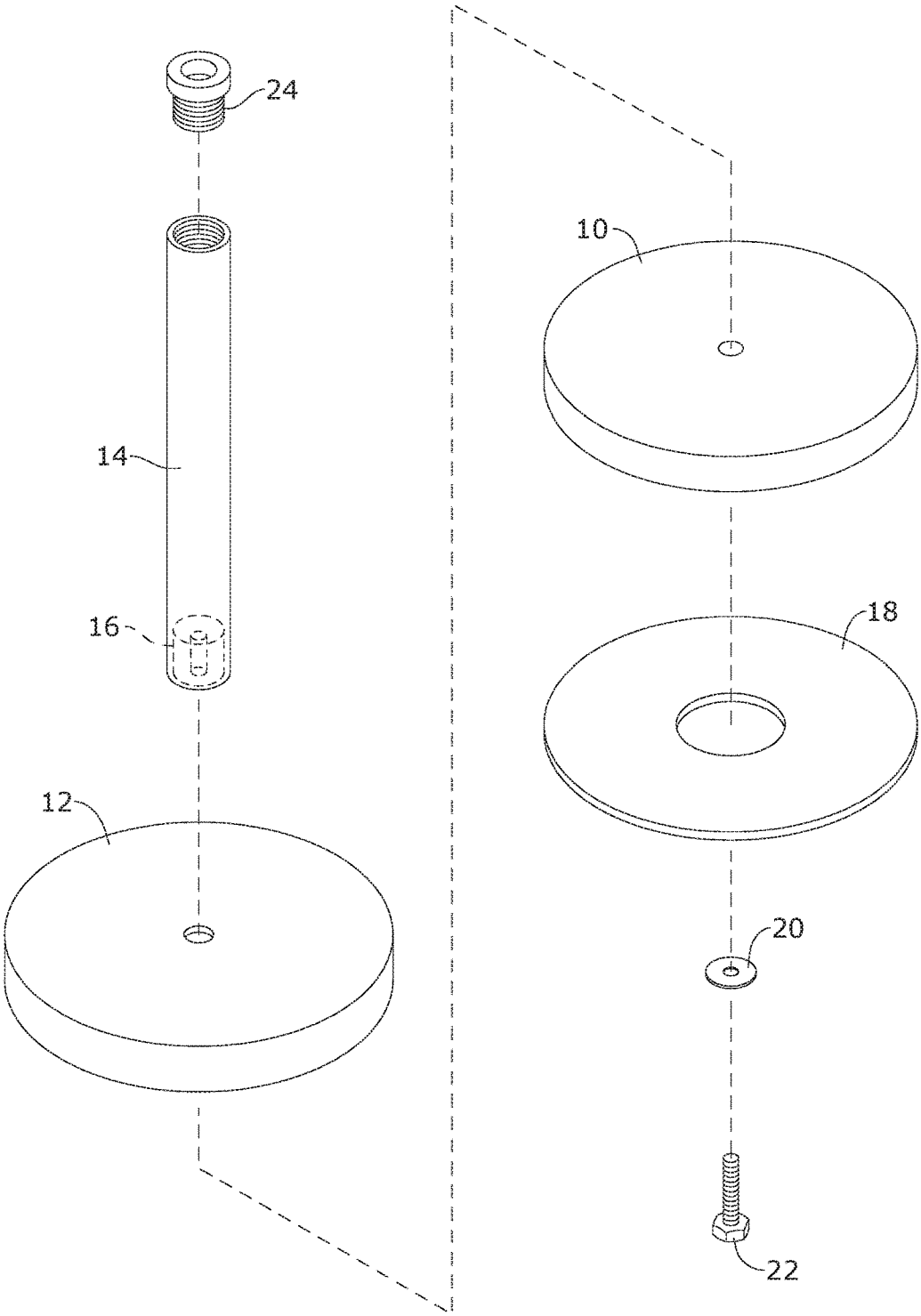
FIG. 3 is an exploded view of an exemplary embodiment of the present invention.
Figure 4:
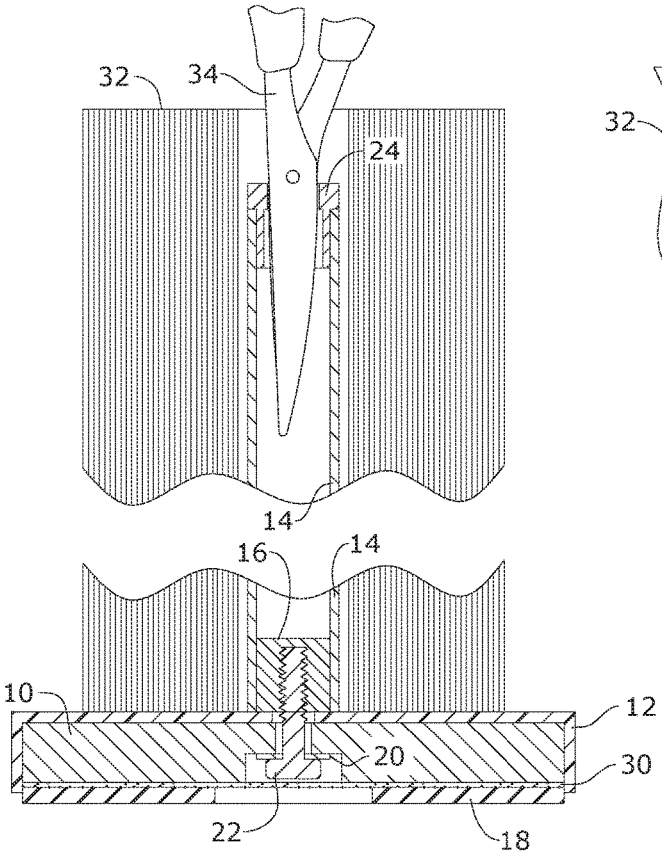
FIG. 4 is a section view of an exemplary embodiment of the present invention, taken along line 4-4 of FIG. 1.
Figure 5:
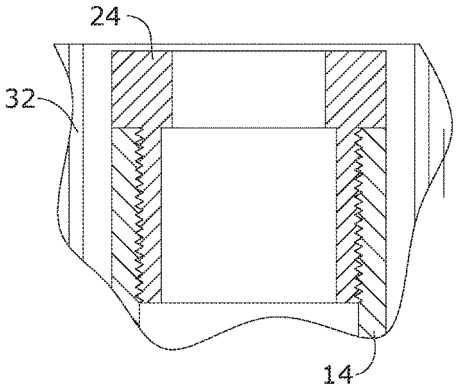
FIG. 5 is an enlarged section view of an exemplary embodiment of the present invention.
Figure 6:
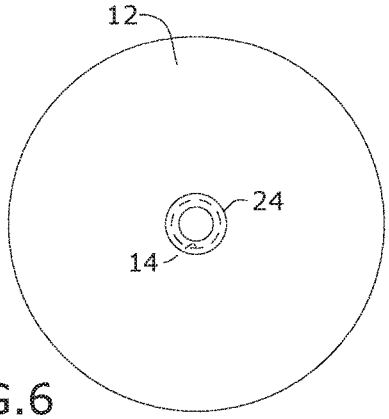
FIG. 6 is a top view of an exemplary embodiment of the present invention.
Figure 7:
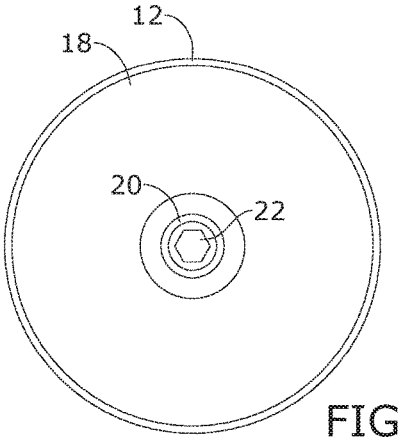
FIG. 7 is a bottom view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides multipurpose retainer adapted to be used as a roller dispenser and for safely storing scissors or shears in a logical home from which and to which users can quickly find and return them.

ITEMIZED PARTS LIST

10 or 46 weighted base (Approx. Diameter: 6"-6½"; Approx. Height: ¾"-1¼")
12 or 48 base cover
14 or 52 tubular element (Approx. Diameter: 1"-1⅝"; Approx. Height: 9"-10 or 46½"
Approx. Thickness of tube material: 1/64"-1/32")
16 female threading
18 or 40 mat (Approx. Diameter: 5"-6½")
20 or 44 secondary fastener
22 or 42 elongated fastener
24 large stopper bolt (Approx. Outside Diameter: 1"-1⅝"; Approx. Inside Diameter: ¾"-1½"; Approx. Height: ½"-2")
26 medium stopper bolt (Approx. Outside Diameter: 1"-1⅝", Approx. Inside
Diameter: ½"-¾"; Approx. Height: ½"-2")
28 small stopper bolt (Approx. Outside Diameter: 1"-1⅝"; Approx. Inside Diameter: ¼"-½"; (Approx. Height: ½"-2")
30 adhesive
32 tubular item
34 elongated object
36 mounting base
38 vertical supporting surface Referring now to FIGS. 1 through 15, the present invention may include a multipurpose retainer 100. The multipurpose retainer 100 may be made of material of sufficient strength to resist the loads disclosed herein. The multipurpose retainer 100 and its associated components may be various materials, colors and shapes as long as they function in accordance with the disclosure herein. The multipurpose retainer 100 may include a tubular member 14 or 52 removably joined at its proximal end to a weighted base 10 or 46, so as to extend generally perpendicularly from the weighted base 10 or 46 to a distal end. The weighted base 10 or 46 may be generally planar with a first and second opposing surface. The weighted base 10 or 46 may be any shape that enables the first surface to rest on a generally horizontal supporting surface. The weighted base 10 or 46 may provide a centrically disposed fastener opening.

The present invention may provide a base cover 12 or 48 dimensioned and adapted to slide over the second and side surfaces of the weighted base 10 or 46, wherein the base cover 12 or 48 provides a centrically disposed cover opening that aligns with the fastener opening. The present invention may provide a mat 18 or 40 of non-slip material providing a centrically disposed mat opening so that when the mat 18 or 40 adheres to a portion of the first surface by way of an adhesive 30 the mat opening aligns with the fastener opening.

The tubular element 14 or 52 has an exterior and interior diameter, with the interior diameter defining the lumen of the tubular element 14 or 52. The proximal end of the tubular element 14 or 52 may provide integrated female threading 16 along its interior diameter, so that an elongated fastener 22 or 42 having complementary male threading (such as a bolt) may slide through the mat, base, and cover opening and join the tubular element 14 or 52 to the weighted base 10 or 46. A secondary fastener 20 or 44, such as a washer, may be employed with the elongated fastener 22 or 42, as illustrated in the Figures.

Figure 15:
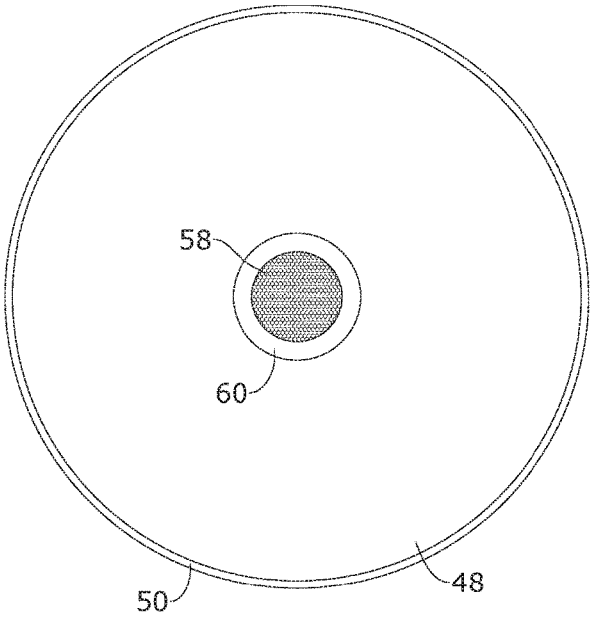
FIG. 15 is a top plan view of an exemplary embodiment of the present invention.
Figure 14:
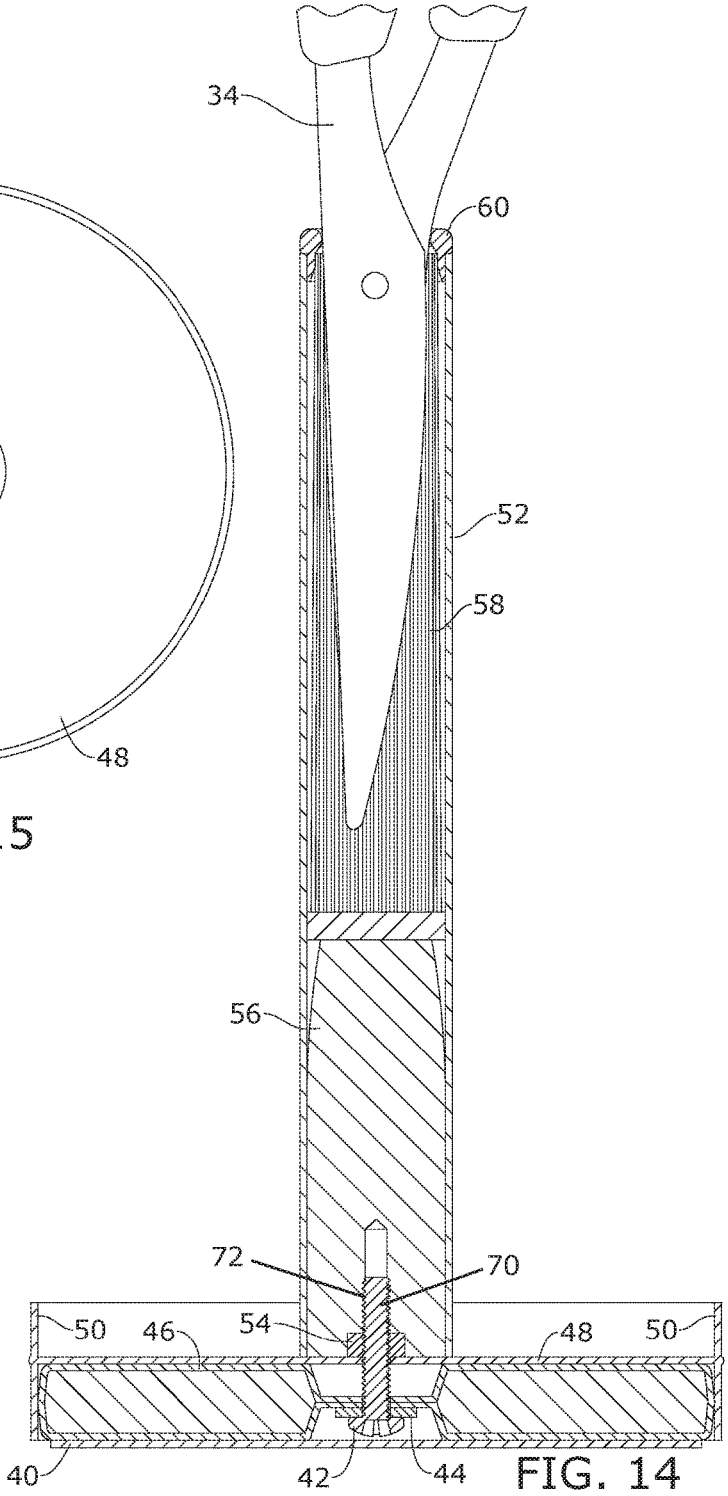
FIG. 14 is a section view of an exemplary embodiment of the present invention, taken along line 14-14 of FIG. 11, wherein a tubular element 32 is not shown for clarity.

In certain embodiments, the elongated fastener 42 engages the female threading 16 of a third fastener 54, such as a nut, so as to secure to the weighted base 10 or 46, while a remaining portion 70 of the elongated fastener 42 and its complementary male threading protrudes therefrom within the tubular element 14 or 52 toward the distal end of the tubular element 14 or 52, as illustrated in FIG. 15. A tube insert 56 may be dimensioned and adapted to slide through the distal end of the tubular element 14 or 52 to the proximal end. The tubular insert 56 may have a proximally disposed threaded portion 72 of the tube insert 56 that securely engages said remaining portion 70.

The distal end of the tube insert 56 provides a platform to support a plurality of densely packed elongated rods 58 so that the distal ends of the elongated rods 58 are adjacent to the opening of the tubular distal end. Each elongated rod 58 may have a diameter ranging between 0.1 and 2 mm and have a length ranging between five and ten inches. The plurality of elongated rods 58 may be packed densely in that each rod 58 may be abutting each adjacent rod 58. The plurality of elongated rods 58 may extend from a shared base 68, wherein the shared base 68 is dimensioned and adapted to slide through the distal end of the tubular element 14 or 52 and onto the distal end of the tubular insert 56. It being understood that the tubular insert 56 may be superfluous depending on the length of the plurality of elongated rods 58 and the distance from the proximal end and distal end of the of the tubular element 14 or 52.

As result, the removable plurality of elongated rods 58 are pivotable relative to their proximal end which is fixed to the shared base. This allows the non-proximal portions of the elongated rods 58 to separate from each other, for example when an object is urged into the plurality of elongated rods 58, yet the rods 58 are still fixed at their predetermined spacing at their proximal ends. The plurality of rods 58 may be made from plasticized materials or the like so that the plurality of elongated rods 58 are flexible yet have the strength to maintain an upright orientation under the force of gravity. The elongated rods 58 as well as other components of the multipurpose retainer 100 may be made of antimicrobial-treated silicone or other equivalent material or any material, such as plasticized material, rubber, vinyl, metallic material and the like, that is durable to function properly in accordance with the disclosure herein.

In use, the distal ends of the removable plurality of elongated rods 58 terminate at, adjacent to, near, or just inward of the distal end/opening of the of the tubular element 14 or 52. The present invention may provide an annular rim 60 adapted to snugly engage the distal end of the lumen of the tubular member 14 or 52, as illustrated in FIGS. 12 through 15, circumscribing the opening of the tubular distal end.

Figure 11:
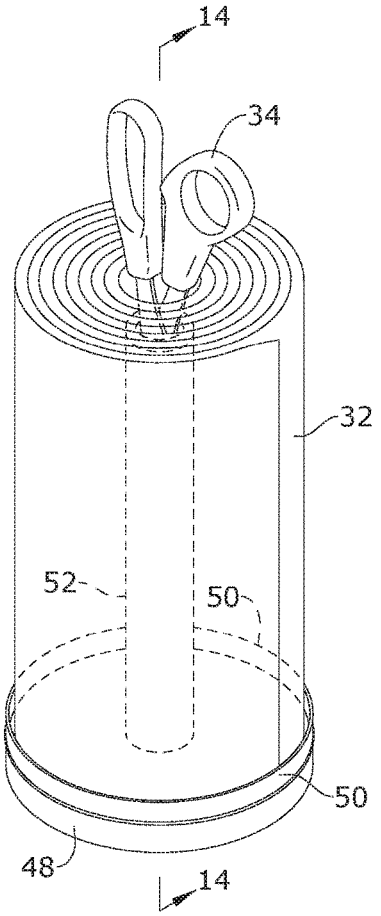
FIG. 11 is a perspective view of an exemplary embodiment of the present invention, shown in use.
Figure 12:
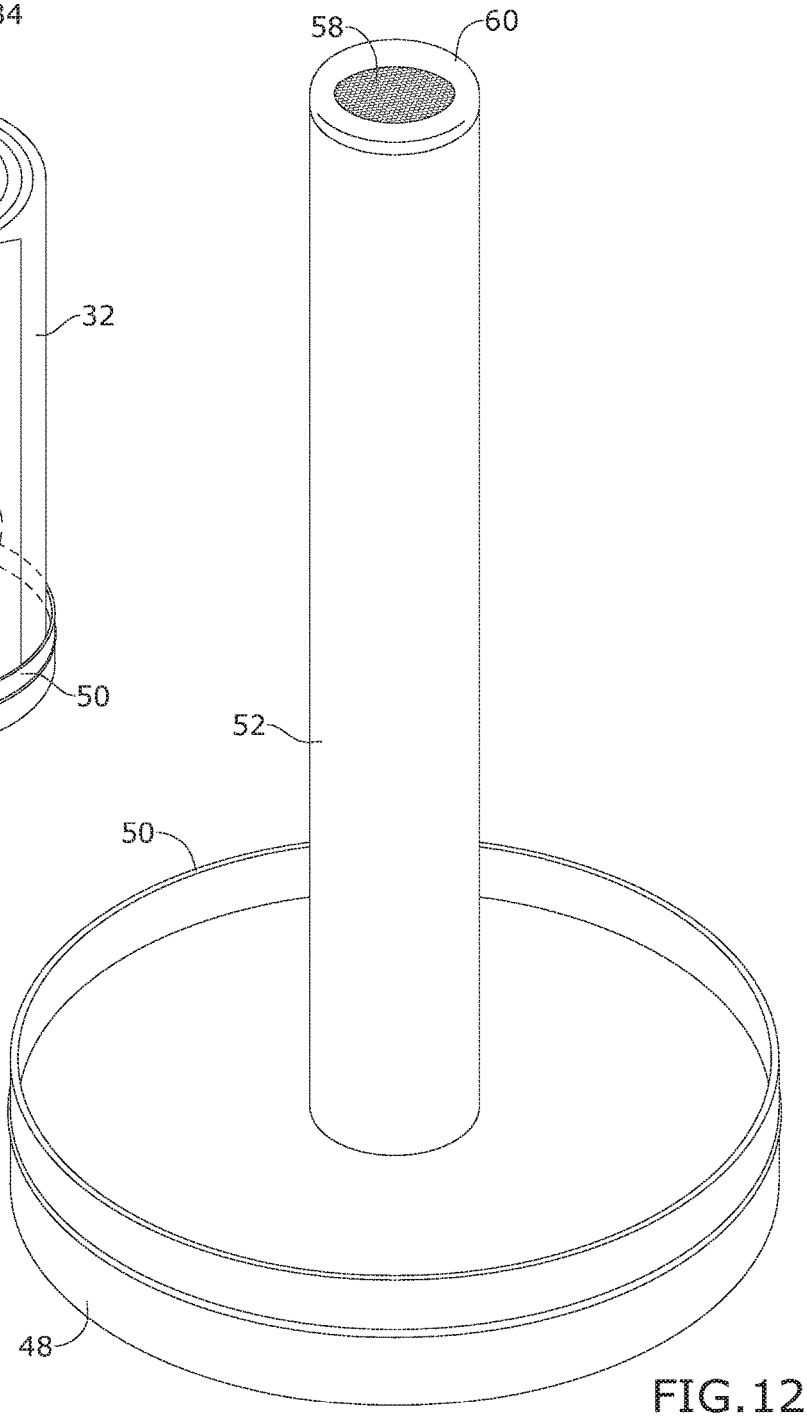
FIG. 12 is a perspective view of an exemplary embodiment of the present invention.
Figure 13:
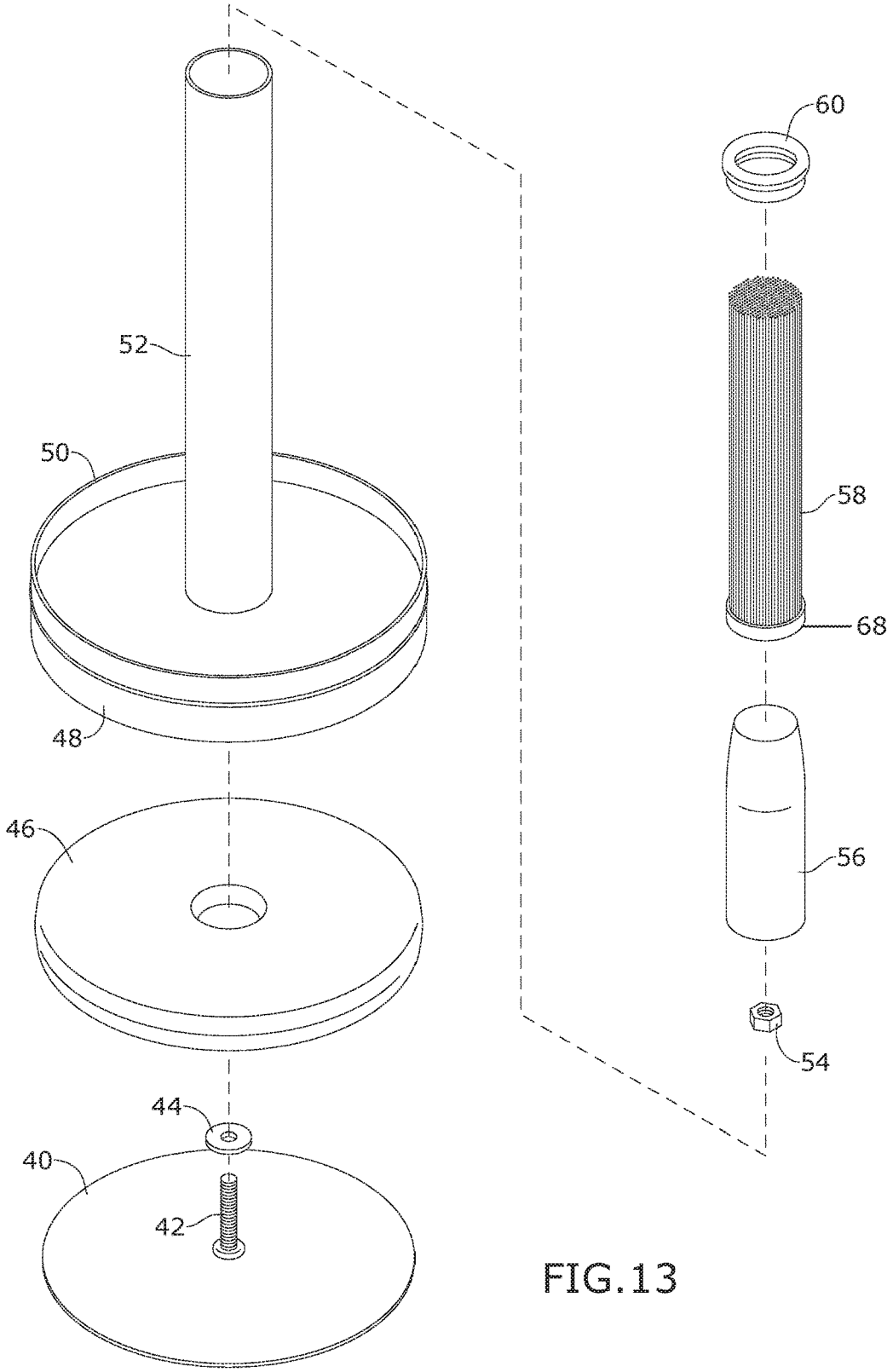
FIG. 13 is an exploded perspective view of an exemplary embodiment of the present invention.

In certain embodiments, the weighted base 46 may provide a peripheral flange 50 extending upward from the top surface of the weighted base 46, as illustrated in FIG. 12. Thereby, the peripheral flange 50 may further secure the tubular item 32 along said top surface, as illustrated in FIG. 11.

The present invention may provide a plurality of stopper bolts 24-28, each adapted to snugly slide into the distal end of the lumen of the tubular member 14 or 52, wherein each stopper bolt provides a flange element having greater exterior diameter than the interior diameter (of the lumen) so as to "catch" on a periphery of the distal end of the tubular element 14 or 52. Each stopper bolt provides a different sized 'donut' opening for slidably receiving different sized elongated objects 34 therein. Each stopper bolt, may have a staggered or tiered opening, wherein the opening associated with the flange element has a diameter greater than a diameter associated with the remaining portion of the donut opening, as illustrated in FIG. 5, 6 9A-10 or 46B, thereby facilitating retaining elongated objects 34 have various widths, especially ones that terminate in a portion having a greater width than that of the elongated portion. Each stopper bolt may be made of an antimicrobial material, such as antimicrobial-treated silicone. The stopper bolts may come in a set of three: a first stopper, a second stopper, and a third stopper, each with a different sized donut opening. For example, the first donut opening may have a first diameter of one-half inch, while the second donut opening may have a second diameter of three-quarter inch, and while the third donut opening may have a third diameter of one inch.

Figure 8:
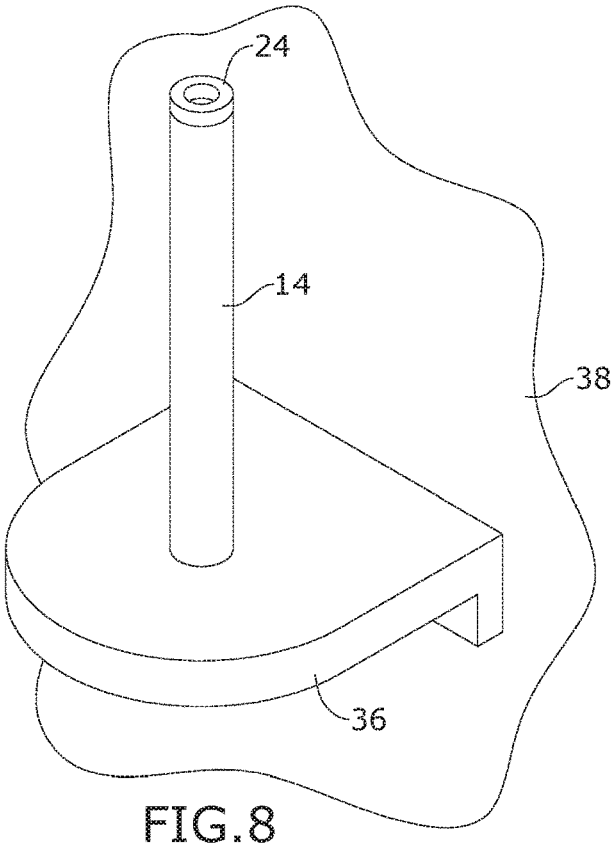
FIG. 8 is a perspective view of an exemplary embodiment of the present invention.
Figure 9A:
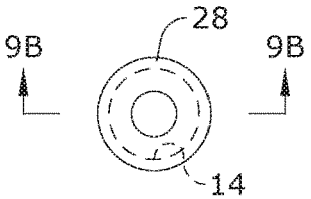
FIG. 9A is a top view of an exemplary embodiment of the present invention.
Figure 10A:
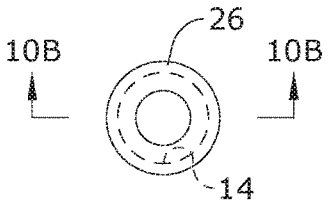
FIG. 10A is a top view of an exemplary embodiment of the present invention.
Figure 9B:
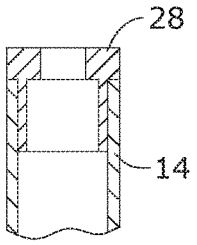
FIG. 9B is a section view of an exemplary embodiment of the present invention, taken along line 9B-9B of FIG. 9A.
Figure 10B:
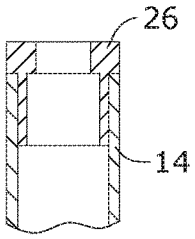
FIG. 10B is a section view of an exemplary embodiment of the present invention, taken along line 10B-10B in FIG. 10A.

In certain embodiments, the multipurpose retainer 100 may have a mounting base 36 adapted to secure to a vertical supporting surface 38, as illustrated in FIG. 8.

A method of using the present invention may include the following. The multipurpose retainer 100 disclosed above may be provided. A user may join the tubular element 14 or 52 to the weighted base 10 or 46, thereby allowing the user to slide thereon a tubular item 32, such as a paper towel roll, so as to rotatably engage the tubular item 32 and the tubular element 14 or 52. Then the user may choose one desired stopper bolt of the plurality of stopper bolts 24-28, and attach the desired stopper bolt to the distal end of the tubular element 14 or 52. Then the user may slide a predetermined elongated object 34, such as a pair of scissors, into the donut opening associated with the desired stopper bolt, wherein a closed pair of scissors or shears may be secured in the lumen of the tubular element 14 or 52 so that handles of the scissors are displayed above the tubular element 14 or 52 and the tubular item 32 so that the latter is still selectively operable. The user may change or interchange a new stopper bolt along the rim of the distal end of the tubular element 14 or 52 to accommodate larger or smaller scissors/shears/elongated object 34.

The method of use may exclude the stopper bolts 24-28, but rather include the following. A user may engage the tube insert 56 with the remaining portion 70 of the elongated fastener 44. Then the user may slide the plurality of rods 58, shared base 68 first, onto the distal end of the tube insert 56 so that the distal ends of the plurality of rods 58 are at or adjacent to the distal end of the tubular element 14 or 52. Then the user may slide a predetermined elongated object 34, such as a pair of scissors, into the plurality of rods 58, whereby the plurality of rods 58 separate to allow the elongated object 34 to slide past, thereby the plurality of rods become more densely packed because of the space taken up by the elongated object 34. The increase in density of rod 58 results in a bias so that the plurality of elongated rods 58 snugly secure the nested elongated object 34 in an upright orientation.

Additionally, the present invention could be used to hold and store objects other than scissors/shears. It could hold a knife, knife sharpening steel, letter opener, hammer, screwdriver, pliers, socket wrench, paint brush, chisel, file, wooden spoon, spatula, whisk, ice cream scoop, can opener, bottle opener, baster, apple corer, cork screw, pie/cake server, fish scaler, garlic press, honey dipper, ladle, lemon reamer, meat tenderizer, melon bailer, nutcracker, pastry brush, peeler, potato masher, pizza cutter, zester, or tongs.

The present invention makes better use of the rolled materials dispenser by giving it a second purpose. The shaft of a rolled materials dispenser is a sturdy and safe place to keep a pair of scissors or shears. Unlike a slot in a knife block, this invention can accommodate a variety of sizes and styles of scissors or shears. Pairing scissors with paper towels makes them logical companions and scissors are easier to find and return to their proper place. The handles of the scissors/shears at the top of the dispenser provide a new decorative and functional appeal.

To make the present invention, an individual could take a round, seamless stainless-steel tube (approximately 10 or 46" h.×1" dia.; 1/32"" thick) that is hollow at the top and has an integrated female threaded nut at bottom and attach the tube to a round weighted stainless steel-covered base (approximately 6" dia.×¾" h.) using a washer and threaded bolt. At the top of the tube that has interior threading, fasten a stopper bolt that screws on to the top edge of the tube while providing an opening that supports a closed pair of scissors or shears in the tube while the handles of the scissors are displayed above the tube and the rolled material on the tube. Change the stopper bolt to accommodate larger or smaller scissors/shears. Add a thin silicone rubber mat with a center hole to the bottom of the base for a non-skid solution. To add color to the design, cover the stainless steel-covered weighted base with a round plastic base cover with center hole that comes in a variety of colors.

It should be understood, of course, that the foregoing relates to exemplary embodiments of the invention and that modifications may be made without departing from the spirit and scope of the invention as set forth in the following claims.

What is claimed is:

1. A kit for operatively dispensing rolled material and simultaneously storing elongated tapered objects, comprising:

a base;

a tubular element extending from a tubular distal end to a tubular proximal end, the proximal end transversely connected to the base;

a plurality of elongated rods perpendicularly extending from a shared base; and the shared base dimensioned to slide through said tubular distal end so as to be supported by said tubular proximal end so that distal ends of the plurality of elongated rods terminate adjacent to said tubular distal end.

2. The kit of claim 1, wherein each elongated rod has a diameter ranging between 0.1 mm and 2 mm.

3. The kit of claim 1, wherein each elongated rod has a length ranging between five and ten inches.

4. The kit of claim 1, wherein the elongated tapered object is a pair of blades or a pair of scissors.

5. The kit of claim 1, wherein the elongated tapered object is slidably received through the tubular distal end and nested within the plurality of elongated rods.

6. The kit of claim 1, further comprising a tubular insert secured to the tubular proximal end so as to support the shared base.

7. A kit for operatively dispensing rolled material and simultaneously storing elongated tapered objects, comprising:

a base;

a tubular element extending from a distal end to a tubular proximal end, the tubular proximal end transversely connected to the base;

a plurality of elongated rods perpendicularly extending from a shared base, wherein each elongated rod has a diameter ranging between 0.1 mm and 2 mm, wherein each elongated rod has a length ranging between five and ten inches; and the shared base dimensioned to slide through said tubular distal end so as to be supported by said tubular proximal end so that distal ends of the plurality of elongated rods terminate adjacent to said tubular distal end, wherein the elongated tapered object is slidably received through the tubular distal end and nested within the plurality of elongated rods.

8. The kit of claim 7, wherein the elongated tapered object is a pair of blades or a pair of scissors.

9. The kit of claim 7, further comprising a tubular insert secured to the tubular proximal end so as to support the shared base.

10. A method of converting a tubular element for dispensing rolled material into a container for storing elongated tapered objects, comprising:

providing that tubular element that extends from a distal end to a tubular proximal end;

providing a plurality of elongated rods perpendicularly extending from a shared base; and sliding the plurality of elongated rods through the tubular proximal end so that the shared base is supported by said tubular proximal end and so that distal ends of the plurality of elongated rods terminate adjacent to said tubular distal end.

* * * * *